US006033265A

United States Patent [19]

Yeh

[11] Patent Number: 6,033,265

[45] Date of Patent: Mar. 7, 2000

[54] CONNECTOR ASSEMBLY

[75] Inventor: Joel Jyh-Haur Yeh, San Gabrie, Calif.

[73] Assignee: Hon Hai Precision Ind. Co., Ltd., Taipei Hsien, Taiwan

[21] Appl. No.: 09/350,792

[22] Filed: Jul. 9, 1999

[51] Int. Cl.[7] ..... H01R 25/00

[52] U.S. Cl. ..... 439/638; 439/79

[58] Field of Search ..... 439/638, 701, 439/79, 653

[56] References Cited

U.S. PATENT DOCUMENTS

| | | | |
|---|---|---|---|
| 5,709,555 | 1/1998 | Noschese | 439/79 |
| 5,709,557 | 1/1998 | Martin et al. | 439/79 |
| 5,823,799 | 10/1998 | Tor et al. | 439/79 |
| 5,897,386 | 4/1999 | Baxter et al. | 439/79 |
| 5,944,536 | 8/1999 | Seong et al. | 439/79 |

*Primary Examiner*—Gary F. Paumen

*Attorney, Agent, or Firm*—Wei Te Chung

[57] ABSTRACT

An electrical connector assembly for use with an input/output card comprises a cartridge defining a receiving space by a pair of side walls. The cartridge defines a front entrance for receiving a complementary connector and a rear portion for receiving a printed circuit board. A connector is assembled in the receiving space for mating with the complementary connector and includes a base plate having a mounting block formed thereon. The block defines a plurality of terminal passageways therein and a plurality of terminals is assembled in the terminal passageways for bridging the complementary connector and the printed circuit board. Latches formed between the cartridge and the connector near the front entrance releasably position the complementary connector therein. Hooks formed between the cartridge and the connector fixedly assemble connector to the cartridge. Mounting slots defined between the cartridge and the input/output card moveably and releasably assemble the cartridge to the input/output card.

1 Claim, 9 Drawing Sheets

CONNECTOR ASSEMBLY

FIELD OF THE INVENTION

The present invention relates to a connector, and more particularly to an X-Jack connector assembly for use with an input/output card.

DESCRIPTION OF THE PRIOR ART

Input/output card has been widely used with the notebook computer. The Input/output card can be a memory card or modem card. For a modem card, an additional female RJ-11 connector is moveably assembled to the card to facilitating connection a plug RJ-11 connector thereto. However a housing of the female RJ-11 connector has the same thickness to the input/output card and defines an opening for vertical insertion of the plug RJ-11 connector. When the thickness of the notebook computer becomes smaller and smaller, there is not enough room for vertical insertion of the plug RJ-11 connector. In addition, according to the experiment insertion/withdrawal between plug/female RJ-11 connectors is limited to 1000 times. Furthermore, female RJ-11 connector needs to provide stopper to limit over-insertion of the plug RJ-11 connector.

SUMMARY OF THE INVENTION

An objective of this invention is to provide a connector assembly for use with an input/output card with compact thickness.

In order to achieve the objective set forth, an electrical connector assembly for use with an input/output card comprises a cartridge defining a receiving space by a pair of sidewalls. The cartridge defines a front entrance for receiving a complementary connector and a rear portion for receiving a printed circuit board. A connector is assembled in the receiving space for mating with the complementary connector and includes a base plate having a mounting block formed thereon. The block defines a plurality of terminal passageways therein and a plurality of terminals is assembled in the terminal passageways for bridging the complementary connector and the printed circuit board. Latches formed between the cartridge and the connector near the front entrance releasably position the complementary connector therein. Hooks formed between the cartridge and the connector fixedly assemble connector to the cartridge. Mounting slots defined between the cartridge and the input/output card moveably and releasably assemble the cartridge to the input/output card.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
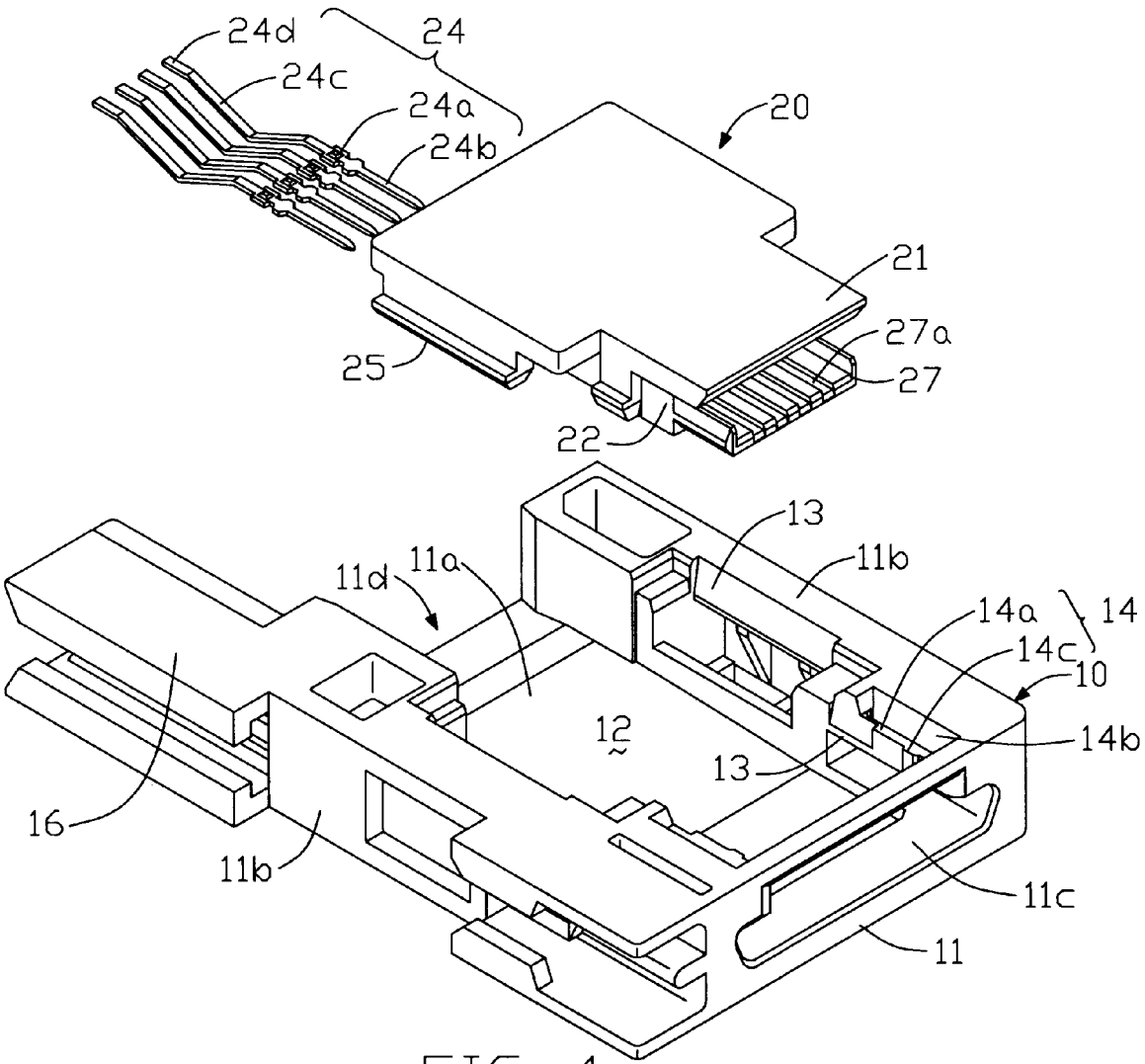
FIG. 1 is an exploded view of a connector assembly in accordance with the present invention.
Figure 2:
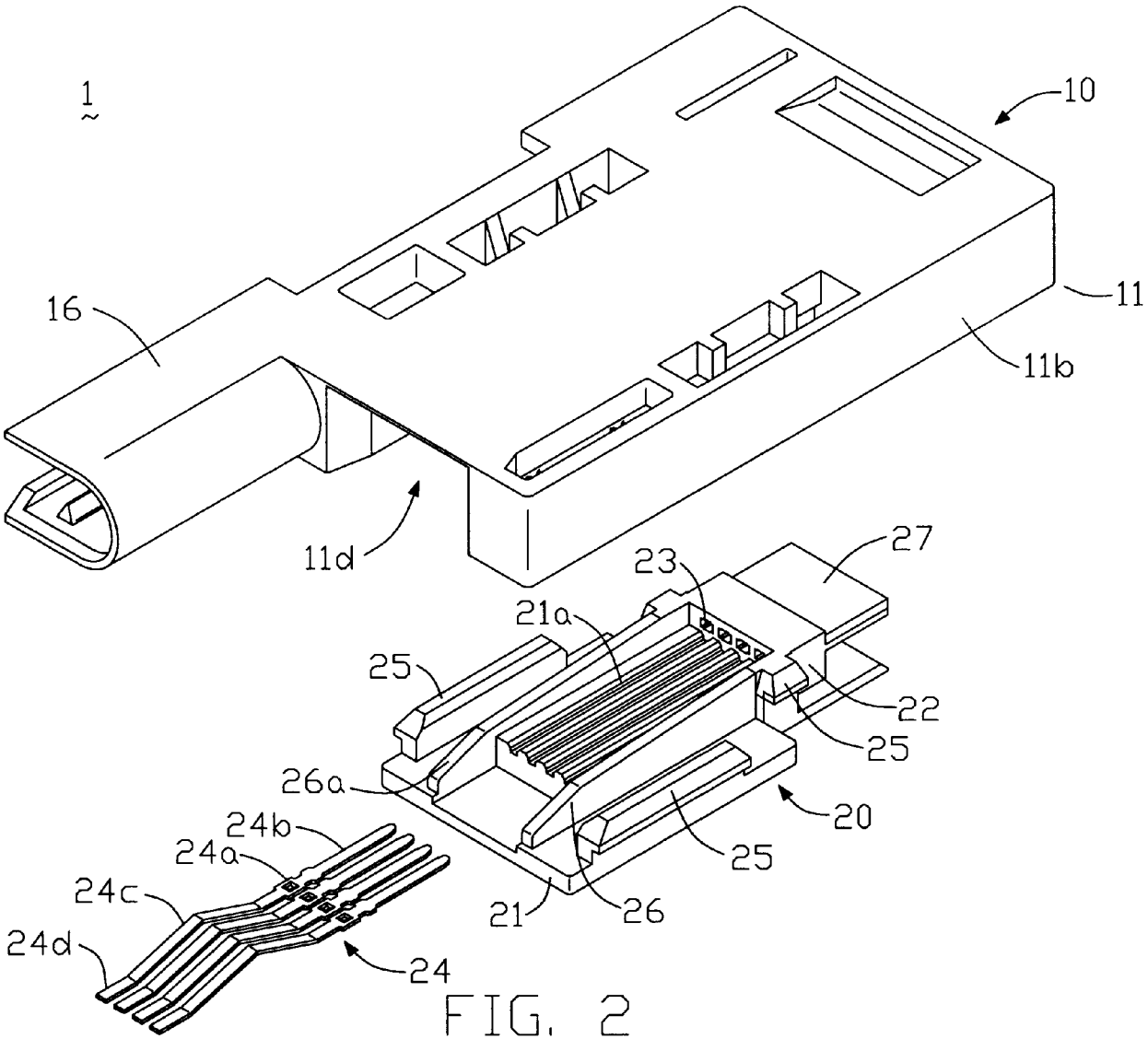
FIG. 2 is similar to FIG. 1 but viewed from a reverse direction.
Figure 3:
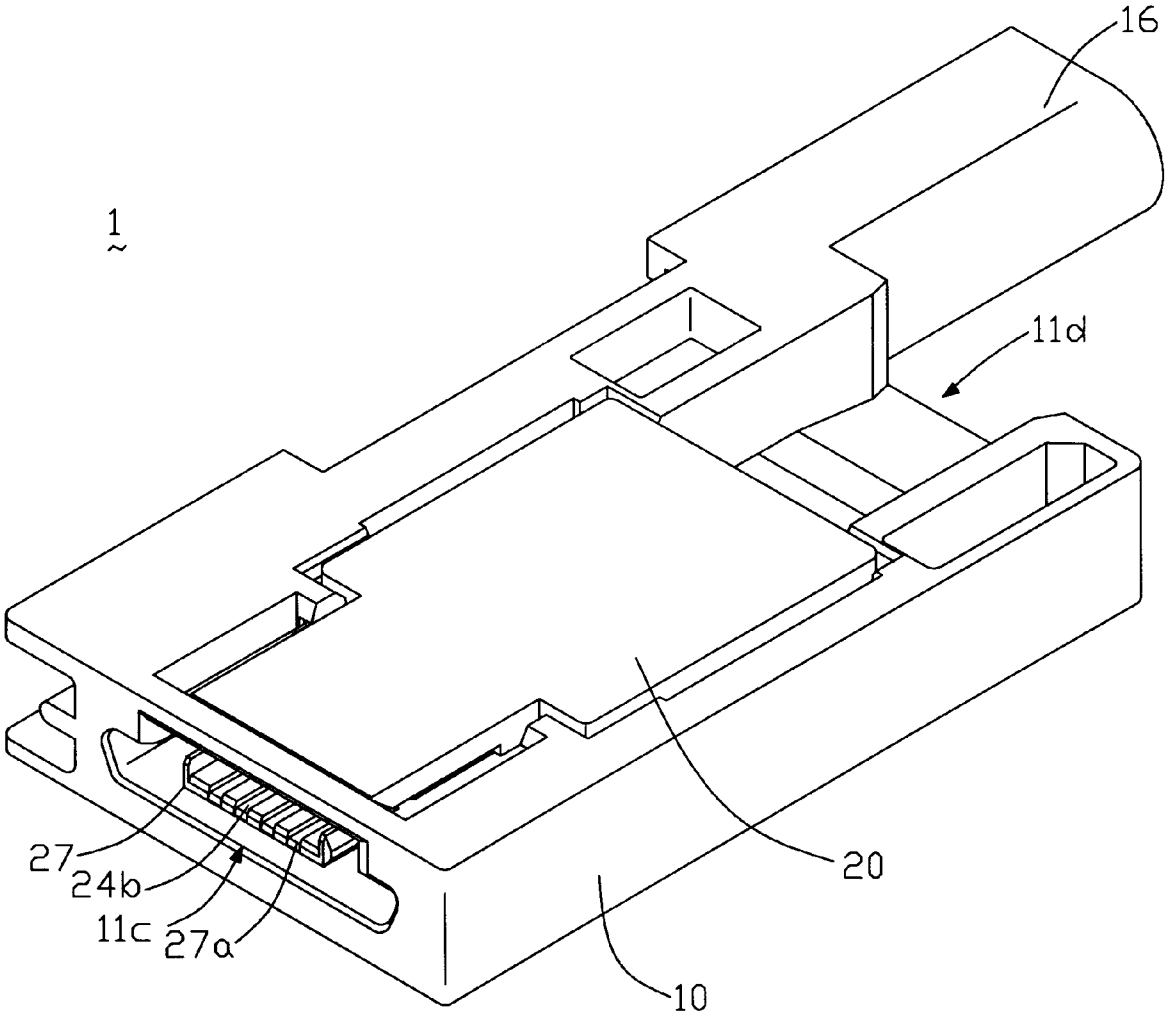
FIG. 3 is an assembled view of FIG. 1.

Referring to FIGS. 1, 2, 3, 4 and 5, an electrical connector assembly 1 for use with an input/output card 50 (FIG. 6) comprises a cartridge 10 and a connector 20 assembled thereto. The cartridge 10 includes a body 11 having a planar bottom plate 11*a* with a pair of sidewalls 11*b* formed on longitudinal sides thereof. A receiving space 12 is defined between said sidewalls 11*b* for receiving the connector 20 therein. The body 11 further defines a front entrance 11*c* for receiving a complementary connector 51 therein and a rear entrance 11*d* for receiving a printed circuit board 52.

A pair of latches 14 is formed adjacent to the front entrance 11*c* for releasably positioning said complementary plug connector 51 therein. Each latch 14 includes a biasing beam 14*a* bridged over a recess 14*b* defined in the sidewall 11*b* and a dimple 14*c* is formed on the biasing beam 14*a*. The biasing beam 14*a* provides resilient force while the dimple 14*c* engages with a cutout 51*b* defined on a tongue portion 51 a of the complementary connector 51. Projections 13 are formed on said sidewalls 11*b*, respectively. A pair of the projections 13 is located adjacent to the latches 14. Coupling slots 16 are formed on an external side of the body 11 for moveably assembling the body 11 to the input/output card 50.

The connector 20 assembled in the receiving space 12 of the cartridge 10 for mating with said complementary connector 51 includes a base plate 21 having a mounting block 22 formed thereon. The block 22 defines a plurality of terminal passageways 23 therein. Four of terminals 24 are assembled in said terminal passageways 23 for bridging said complementary connector 51 and said printed circuit board 52. Hooks 25 formed on longitudinal sides of said base plate 21 for snugly engaging with projections 13 of the cartridge 10. By this arrangement, the connector 20 can be snugly assembled in the cartridge 10. The base plate 21 further includes a pair of guiding ridges 26 extending longitudinally and rearwardly from said block 22.

Figure 7:
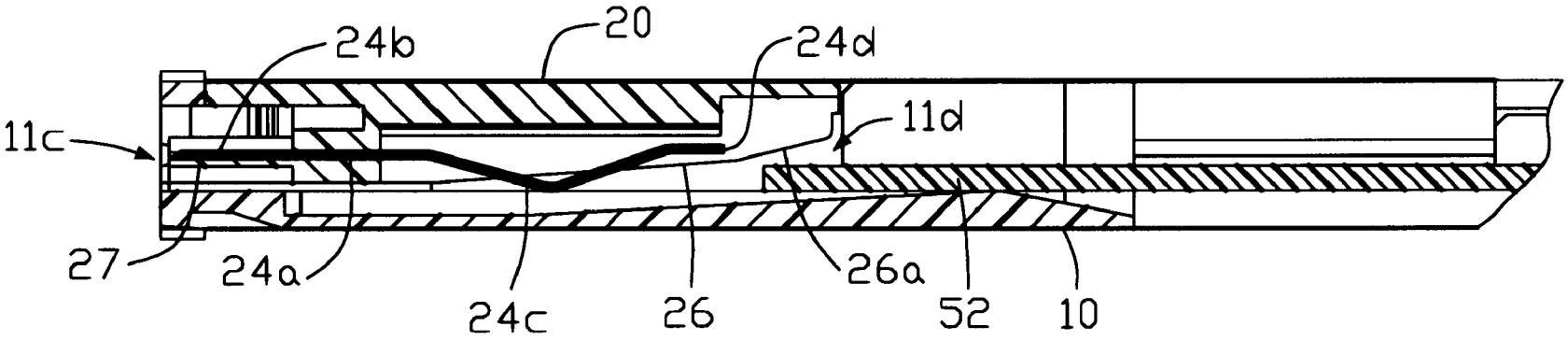
FIG. 7 is a cross sectional view taken along line VII—VII of FIG. 6.

Each terminal 24 includes a body portion 24*a* fixedly positioning in said passageway 23, a mating portion 24*b* extending forwardly from said block 22, and a tail portion 24*c* extending rearwardly. Tips 24*d* of the tail portions 24*c* are located within a space defined between the guiding ridges 26. By this arrangement, the tips 24*d* of the tail portions 24*c* will not collide with the inserted printed circuit board 52 (FIG. 7). In addition, each guiding ridge 26 includes a slanted portion 26*a* for easy insertion of the printed circuit board 52.

In order to neatly administer the terminals 24, four guiding slot 21*a* extending longitudinally between said guiding ridges 26 and each receives a corresponding terminal 24 therein.

A back plate 27 extends from said block 22 for backing said mating portions 24*b* of said terminals 24. The back plate 27 further includes a plurality of guiding slots 27*a* for receiving said mating portions 24*b* therein.

Figure 4:
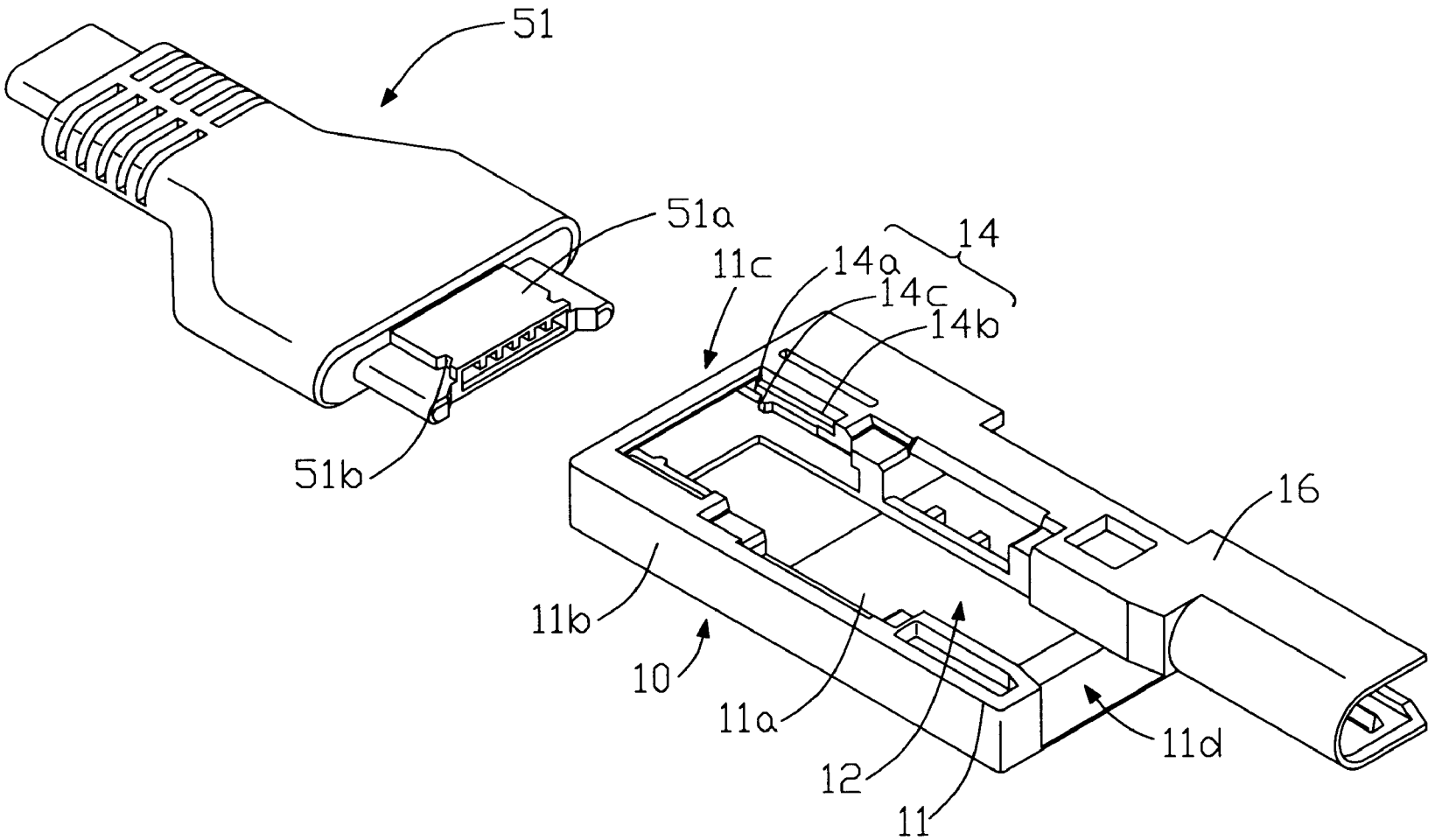
FIG. 4 is a perspective view showing a complementary connector mated to the connector assembly of FIG. 1.
Figure 5:
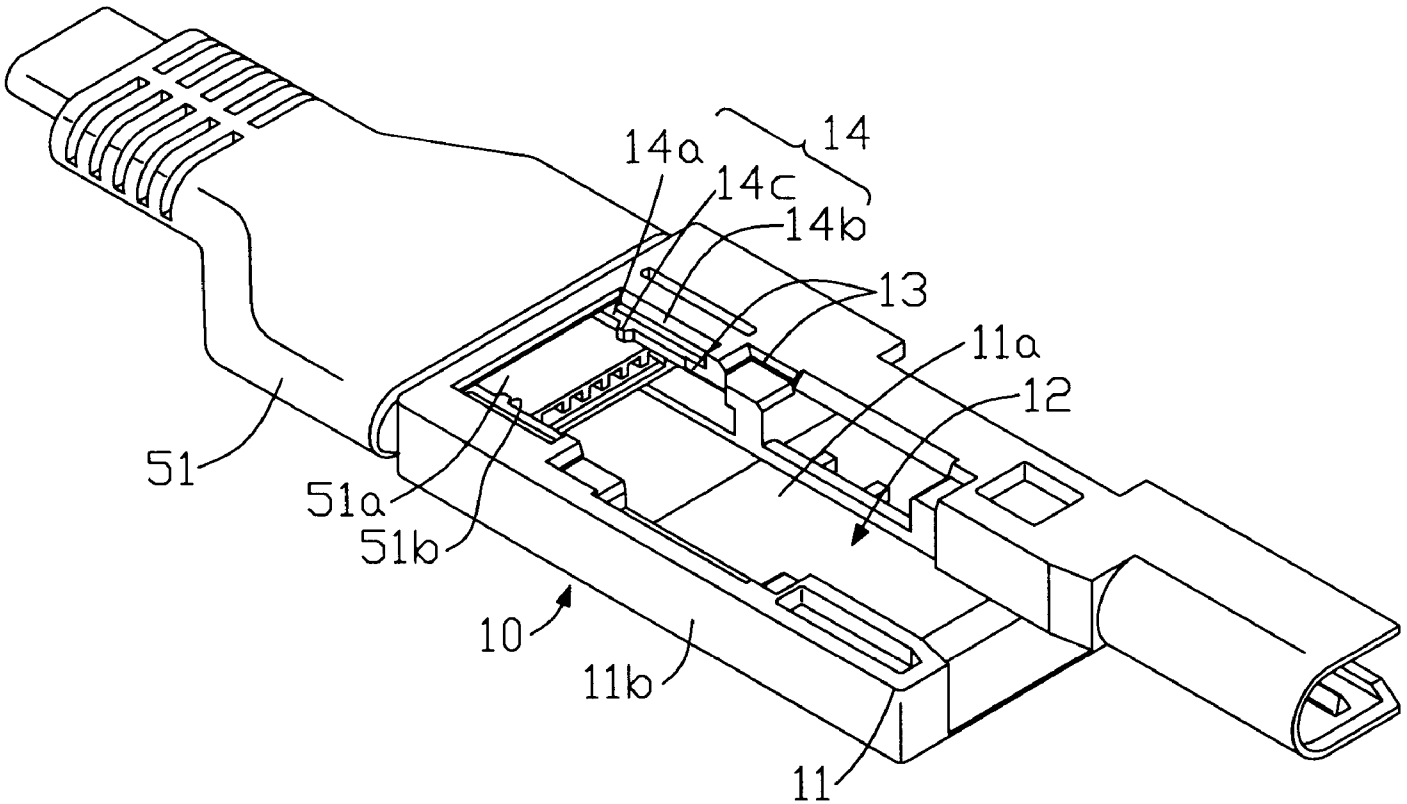
FIG. 5 is a perspective view showing the complementary connector and the connector assembly are assembled.

FIG. 4 discloses the complementary connector 51 is to assemble to the cartridge 10 on which the connector 20 is not assembled thereto. FIG. 5 shows the complementary connector 51 is assembled to the cartridge 10 wherein the cutouts 51*a* of the tongue portion 51*a* are engaged with the dimples 14*c* of the latches 14.

Figure 6:
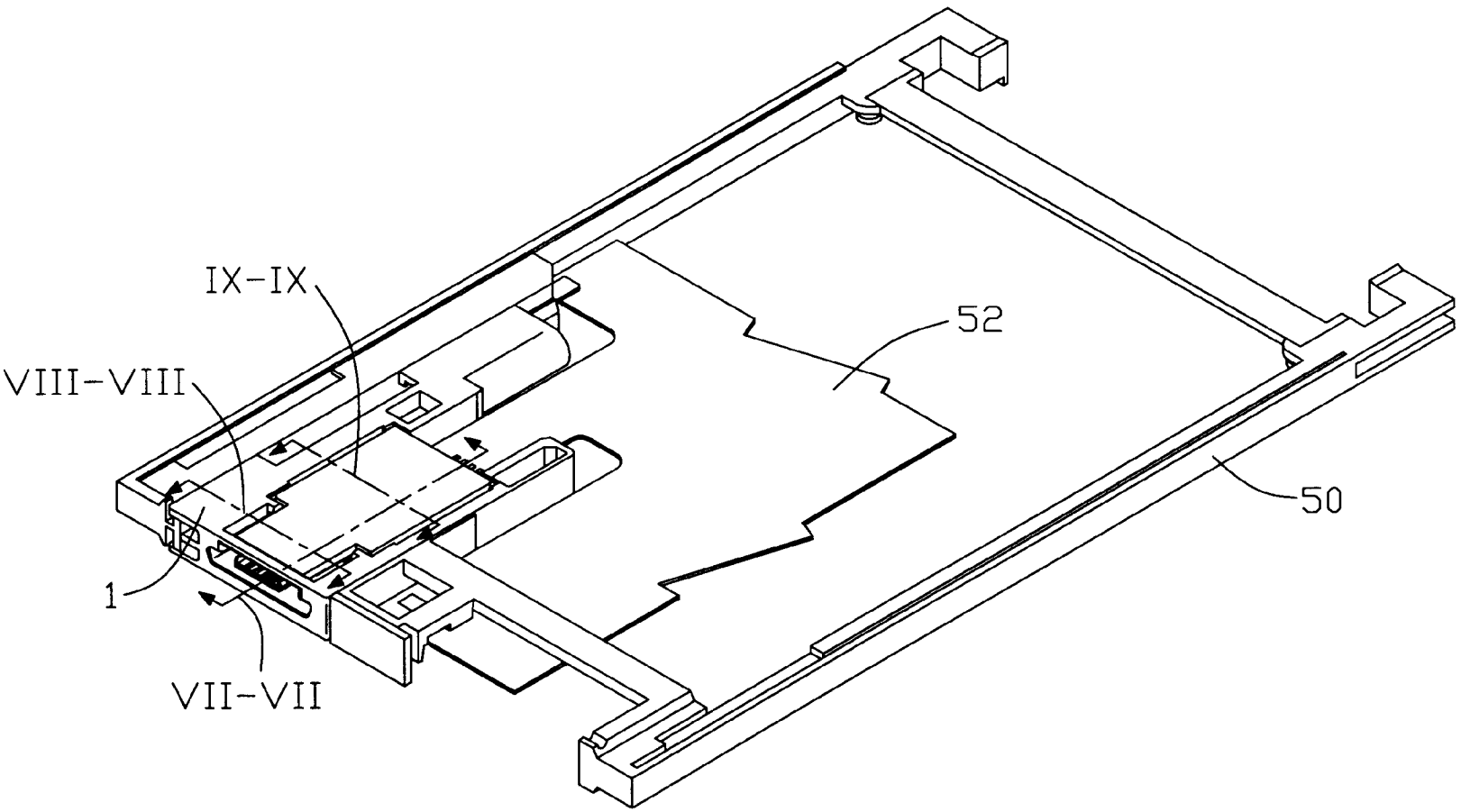
FIG. 6 is a perspective showing the connector assembly is assembled to an input/output card.

FIG. 6 is a perspective view showing a connector assembly 1 is moveably assembled to the input/output card 50. The connector assembly 1 can be easily assembled/disassembled thereto.

FIG. 7 is a cross sectional view taken along line VII—VII of FIG. 6. It can be readily appreciated that the tips 24*d* of the terminals 24 are well protected by the guiding ridges 26. As a result, the printed circuit board 52 can be easily inserted therein without collision to the tips 24*d*. Deformation of the terminals 24 because of collision with the inserted printed circuit board 52 is therefore advantageously avoided.

Figure 8:
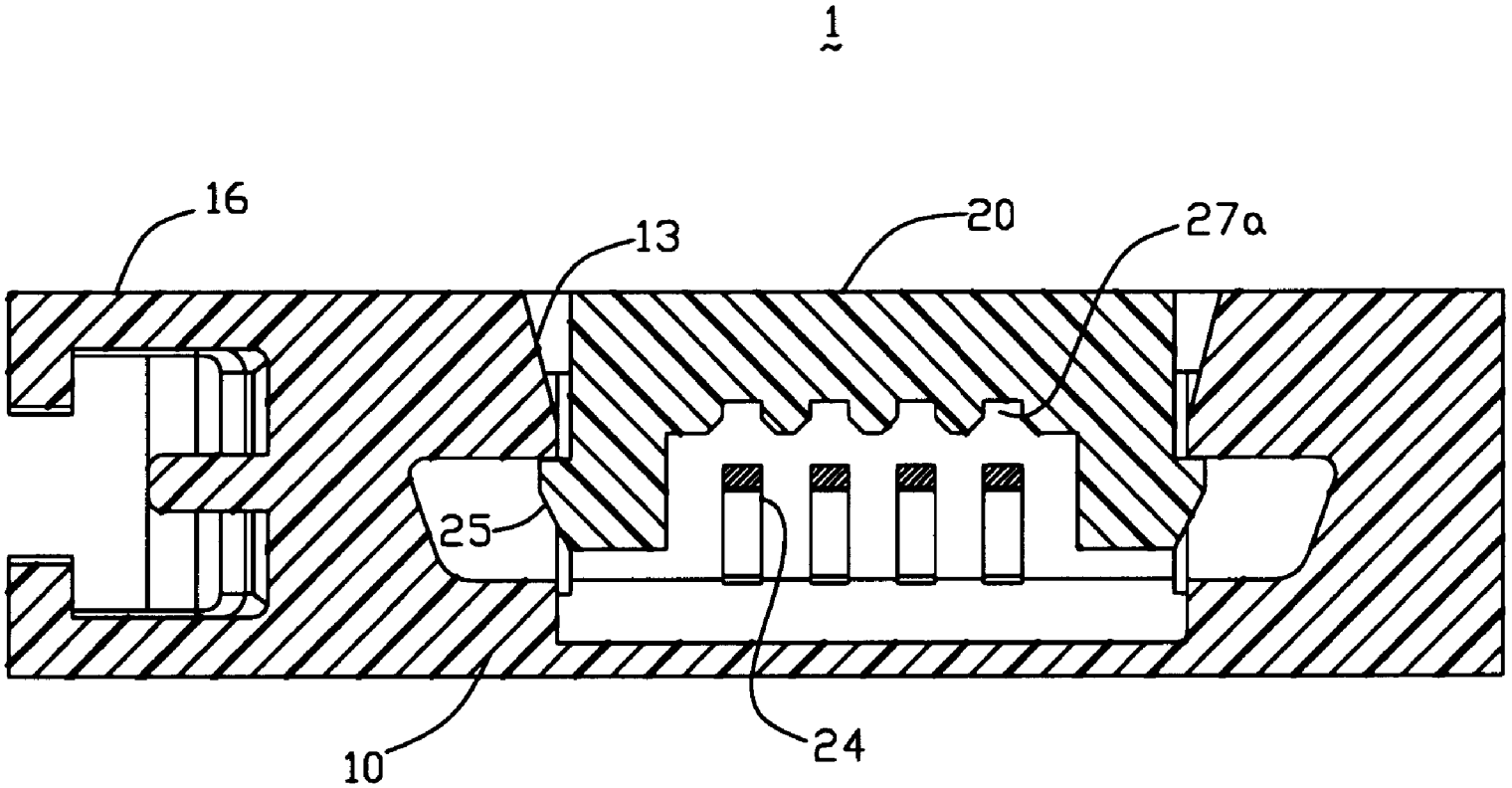
FIG. 8 is a cross sectional view taken along line VIII—VIII of FIG. 6.
Figure 9:
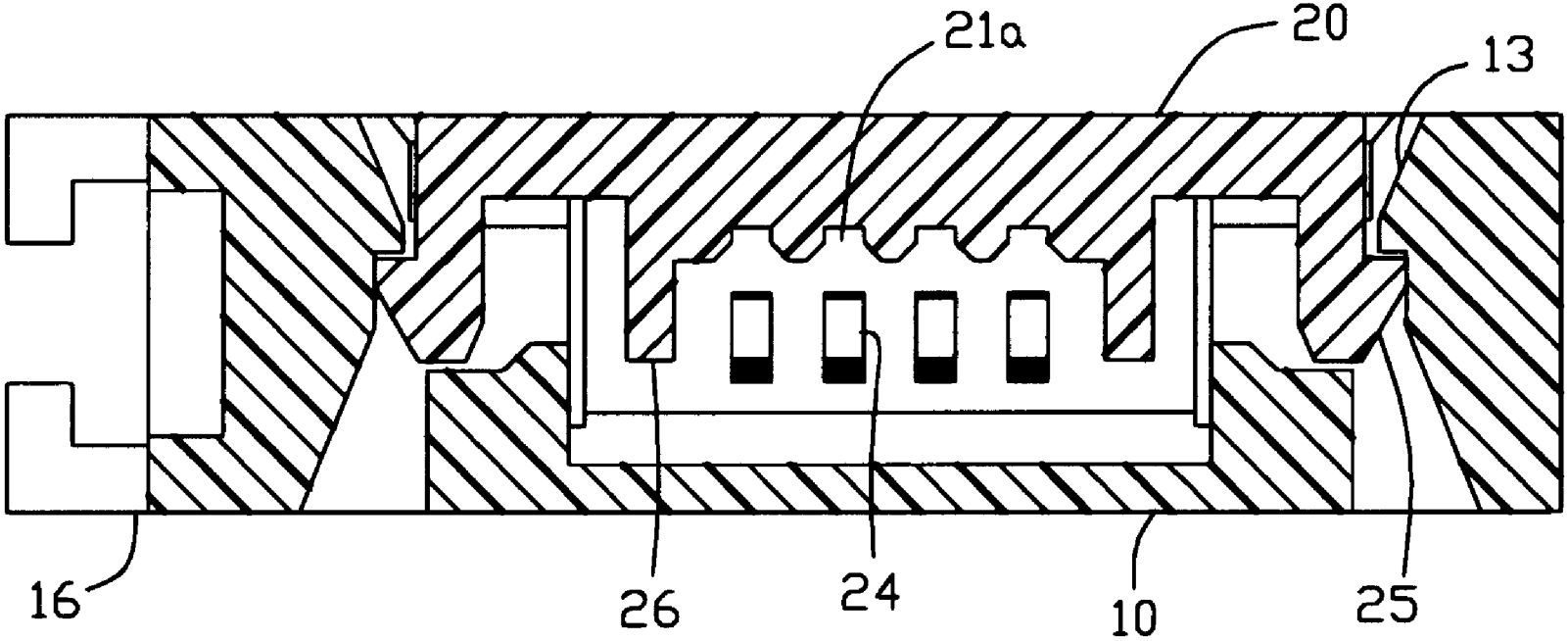
FIG. 9 is a cross sectional view taken along line XI—XI of FIG. 6.

FIGS. 8 and 9 are cross sectional views showing engagement between the projections 13 and the hooks 25 thereby the connector 20 is fixedly and reliably assembled within the cartridge 10.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector assembly for use with an input/output card, comprising:

a cartridge defining a receiving space by a pair of side walls, said cartridge defining a front entrance for receiving a complementary connector and a rear portion for receiving a printed circuit board;

a connector assembled in said receiving space for mating with said complementary connector and including a base plate having a mounting block formed thereon, said block defining a plurality of terminal passageways therein, a plurality of terminals assembled in said terminal passageways for bridging said complementary connector and said printed circuit board;

locking means between said cartridge and said connector near said front entrance for releasably positioning said complementary connector therein;

interengaging means between said cartridge and said connector for fixedly assembling said connector to said cartridge; and intercoupling means between said cartridge and said input/output card for moveably and releasably assembling said cartridge to said input/output card;

wherein a pair of guiding ridges are formed between said cartridge and said base plate for guiding said printed circuit board;

wherein each terminal includes a body portion fixedly positioned in the respective passageway, a mating portion extending forwardly from said block, and a tail portion extending rearwardly;

wherein tips of said tail portions of said terminals are located within a space defined by said guiding ridge.

* * * * *